US006374457B1

(12) United States Patent
Kuo

(10) Patent No.: US 6,374,457 B1
(45) Date of Patent: Apr. 23, 2002

(54) HANDLE OF A TRUNK

(75) Inventor: Chung-Hsien Kuo, Taipei Hsien (TW)

(73) Assignee: Chaw Khong Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 09/609,700

(22) Filed: Jul. 3, 2000

(51) Int. Cl.[7] ..... B25G 1/04; A45C 3/00; B62B 7/00

(52) U.S. Cl. ..... 16/113.1; 190/39; 190/115; 280/655; 280/655.1

(58) Field of Search ..... 16/113.1, 405, 16/429; 190/39, 115, 18 A; 280/655, 655.1, 47.31, 47.315

(56) References Cited

U.S. PATENT DOCUMENTS 5,581,846 A * 12/1996 Wang ..... 16/113.1
5,639,109 A * 6/1997 Liang ..... 280/655
5,781,965 A * 7/1998 Lu ..... 16/113.1
5,816,374 A * 10/1998 Hsien ..... 16/113.1
5,822,831 A * 10/1998 Cheng ..... 16/113.1
5,862,898 A * 1/1999 Chang ..... 16/113.1
5,864,921 A * 2/1999 Chou ..... 16/113.1
6,026,542 A * 2/2000 Lu ..... 16/113.1
6,061,871 A * 5/2000 Wang ..... 16/113.1

* cited by examiner

*Primary Examiner*—Chuck Y. Mah
(74) *Attorney, Agent, or Firm*—Rosenbegr, Klein & Lee

(57) ABSTRACT

A handle of a trunk comprises a cover and a seat, in which a telescopic pull rod is connected to a handle at an upper hand thereof. Each of two sides of the seat and cover are installed with a lower through hole and an upper through hole. The lower through hole is connected to the push rod. The left lever is disposed with a pressing piece. A driving means is connected between the seat and the cover. The driving means is formed by a left and a right levers. A linkage is connected between the two left levers. Two ends of the driving means are connected to the pressing piece and further connected to a driven means. A lower end of the driven means passes through the push rod to a retaining piece. If pressing piece is pressed, the driving means will drive the driven means at two sides so that the push rod is released to be moved telescopically. In another type of the driving means, two ends thereof are connected with a respective lever type rack. A rack portion is installed therein. A gear is connected between the racks so that the two lever type rack are interacted.

8 Claims, 9 Drawing Sheets

HANDLE OF A TRUNK

FIELD OF THE INVENTION

The present invention relates to a handle of a trunk, and especially to a handle structure which is comfortable in holding and has a preferred push control structure.

BACKGROUND OF THE INVENTION

FIG. 9 shows a prior art handle of a trunk which is formed by a handle 6 and a related control means. A control button 63 is installed at a concave portion 62 of the handle 61. A groove 64, a pair of inner lever 65 and outer lever 66 and a resilient spring 67 is installed in the handle 61. A pair of inner tubes 71 are connected to the two ends of the handle 6. The inner tube 71 is inserted into an outer tube 72. The inner lever 65 and outer lever 66 fixed by a pin, and the resilient spring 67 are installed in the groove 64. The top edge of the inner tube 71 is connected to the handle 6. The opening at top of the inner tube 71 is installed with a buckling concave pad 73. A driven push rod 74 in the inner tube 71 penetrates through the inner tube 71 through the handle 6 to a tilt block in a barrel 75. A buckling block 76 and an eject spring in the buckling block 76 are installed in the barrel 75. The bottom of the barrel 75 can be sealed. A plurality of buckling holes 77 are installed at the wall of the outer tube 72, and a plurality of retaining holes 78 are installed on the inner tube 72. By two lower edges of the handle 6 to contact with the inner tube 71 and then to be connected to the outer tube 72, the push rods 71 and 72 of the trunk can be controlled by the switch 73 for adjusting the elevation of the push rod (a pair of inner tube and outer tube). However, this prior art structure has many defects in applications, for example, protrusions or grooves are formed at the middle portion of the handle, this is not beneficial to be hold by a hand. Furthermore, mistakes are easily induced by the uncomfortably feeling of the handle. Therefore, there is an eager demand for a novel design of a handle of a trunk which can improve the defects in the prior art.

SUMMARY OF THE INVENTION

Accordingly, the primary object of the present invention is to provide a handle of a trunk. Since in the prior art, the push control structure is installed at the upper and lower lateral sides of the middle portion of the handle, this is inconvenient to be held by a hand and the comfort feeling in holding is also affected. Therefore, the present invention provides an integral structure without concave edge portion at the handle for meeting the requirement in ergonomics.

Another object of the present invention is to provide a handle of a trunk, in which the push control structure is installed at two sides thereof. If it is necessary to adjust, it is only needed to press the pressing piece by thumb, and a telescopic adjustment is formed. Therefore, the present invention can be used conveniently instead of the prior art in which the hand holding the handle must in advance release from the handle. In the present invention, the adjusting work is performed in holding as desired.

In order to achieve the aforesaid object, the present invention provides a handle of a trunk comprises a cover and a seat, in which a telescopic pull rod is connected to a handle at an upper hand thereof. Each of two sides of the seat and cover are installed with a lower through hole and an upper through hole. The lower through hole is connected to the push rod. The left lever is disposed with a pressing piece. A driving means is connected between the seat and the cover.

The driving means is formed by a left and a right levers. A linkage is connected between the two left levers. Two ends of the driving means are connected to the pressing piece and further connected to a driven means. A lower end of the driven means passes through the push rod to a retaining piece. If pressing piece is pressed, the driving means will drive the driven means at two sides so that the push rod is released to be moved telescopically. In another type of the driving means, two ends thereof are connected with a respective lever type rack. A rack portion is installed therein. A gear is connected between the racks so that the two lever type rack are interacted. The seat and the cover are installed with protrusions with respect to the driving means, so that the driving means move in the space between the protrusions of the driving means.

The various objects and advantages of the present invention will be more readily understood from the following detailed description when read in conjunction with the appended drawing.

DETAILED DESCRIPTION OF THE PREFERRED EMBODIMENTS

Figure 1:
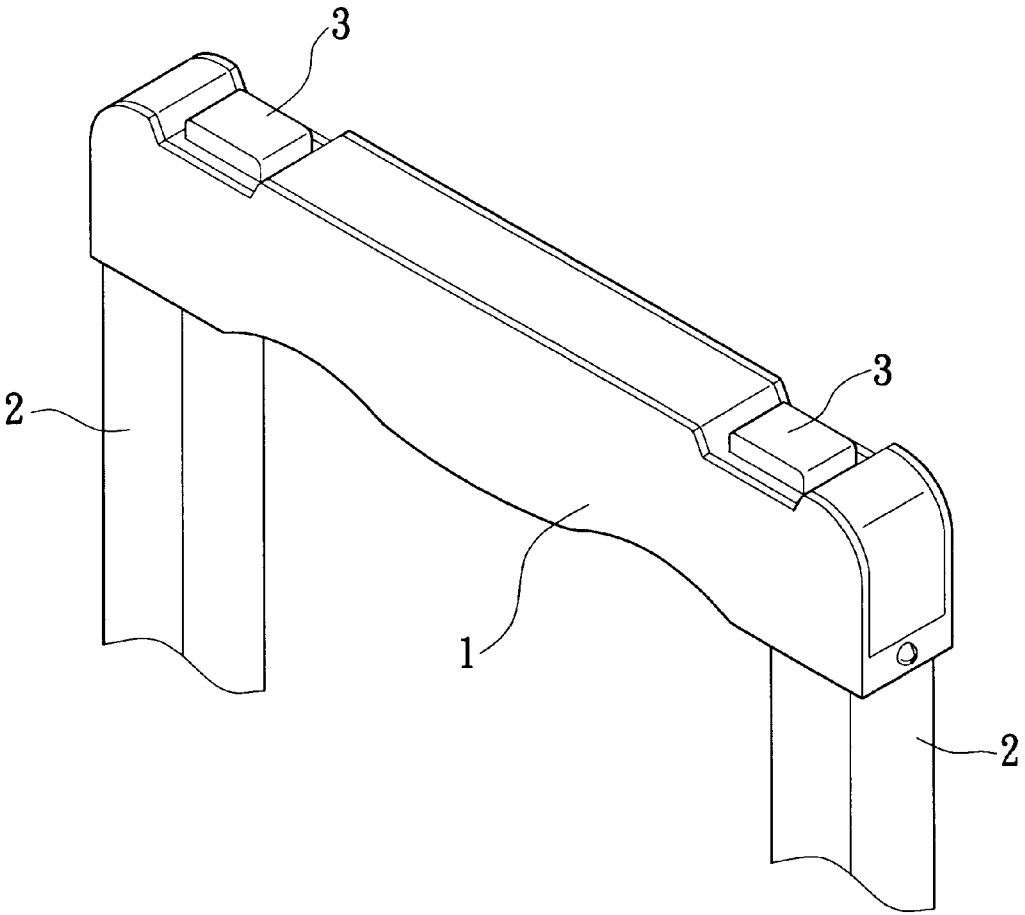
FIG. 1 is a perspective view of the present invention.
Figure 2:
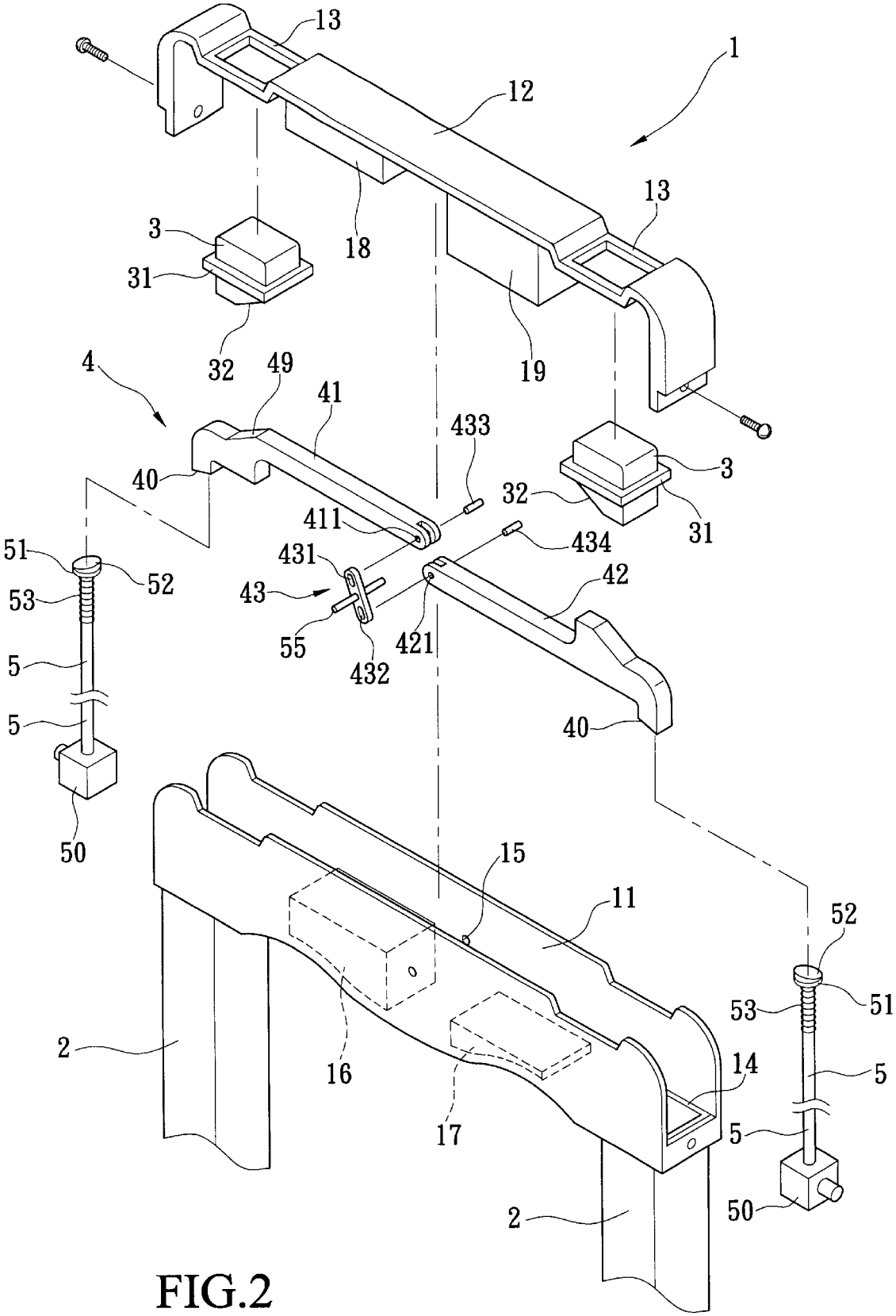
FIG. 2 is an exploded perspective view of the present invention.
Figure 3:
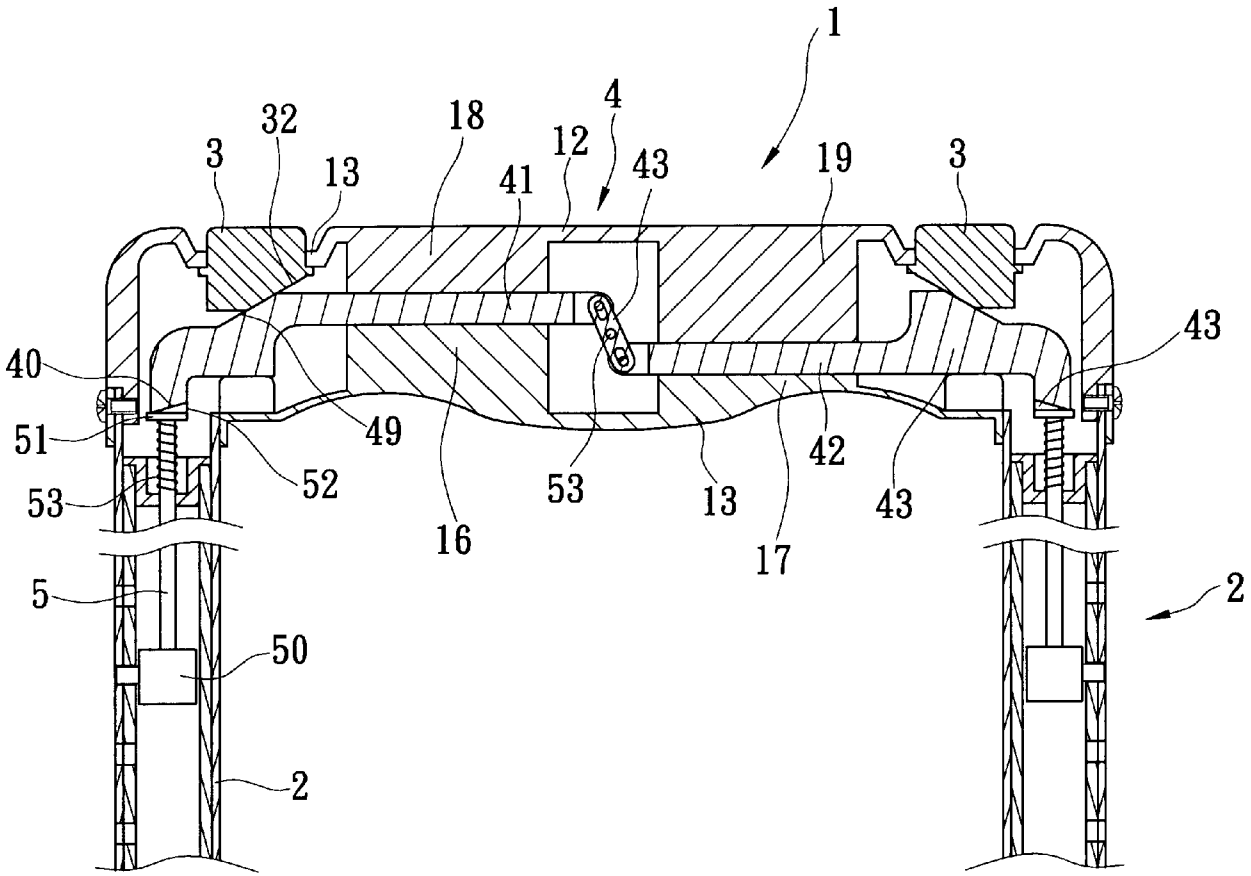
FIG. 3 is an assembled cross sectional view of the present invention.
Figure 4:
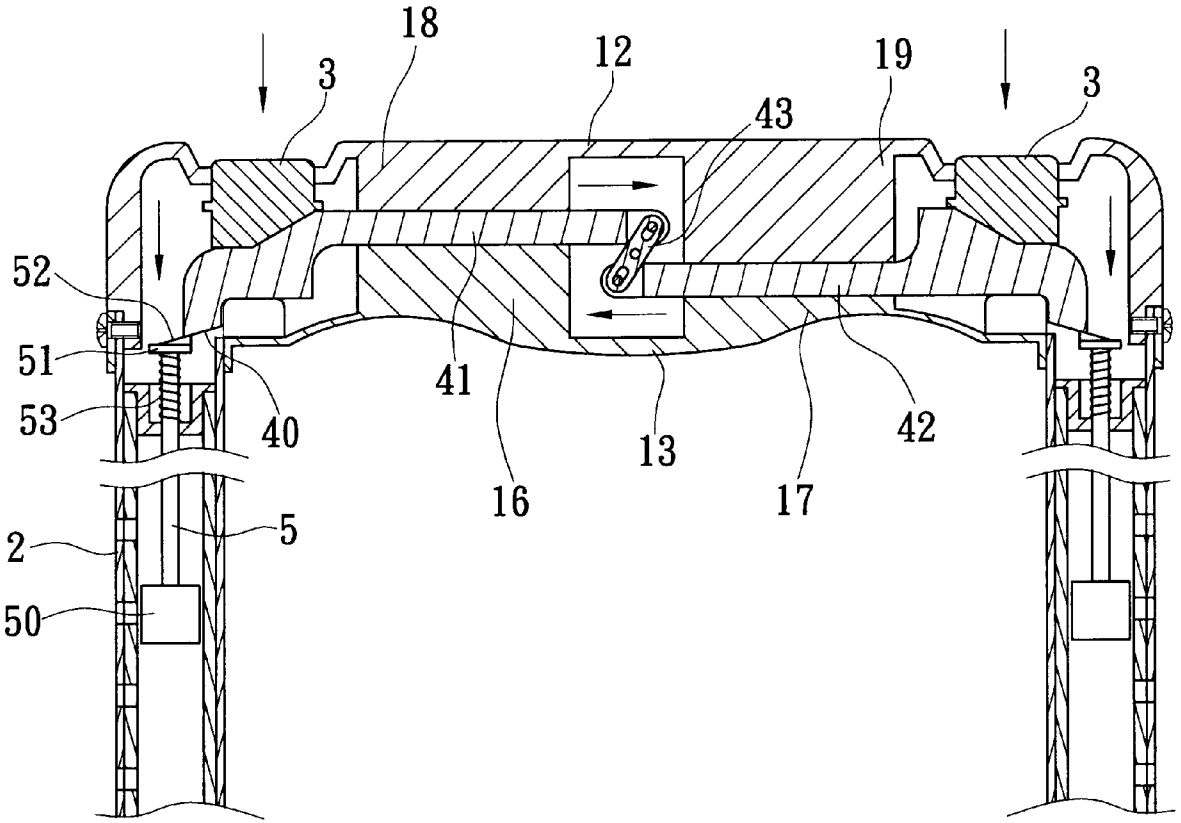
FIG. 4 is a cross sectional view showing the action of the present invention.

With reference to FIGS. 1 to 8,the handle of a trunk of the present invention is illustrated herein. In the handle of the present invention, a pair of telescopic push rods 2 are connected with a handle 1 at the upper end thereof. The handle 1 includes a cover 12 and a seat 11. There are various types of handles which are not confined to those shown in the figures. Each of two sides of the seat 11 and cover 12 are installed with a respective lower through hole 14 for matching with the push rod 2 and an upper through hole 13. The lower through hole 14 is connected to the upper end of the topmost rod of the push rod 2. The upper through hole 13 is disposed with a pressing piece 3. A driving means 4 is connected between the seat 11 and the cover 12. As shown in FIGS. 2 to 4, the driving means 4 is formed by a left lever 41 and a right lever 42. The two levers 41 and 42 are connected by a linkage 43 at the inner sides thereof. The linkage 43 is secured to a pin seat 15 f the seat 11 by a pin 55. Two ends of the linkage 43 have respective long holes 431 and 432 which are passed by retaining pins 433 and 434, respectively, to be connected to the retaining holes 411 and 421 within the levers 41 and 42. The long holes on the linkage 43 serve to cause the levers to move horizontally. The rotation of the linkage will not cause the levers to lift upwards. The outer end of each of the levers 41 and 42 is connected to a respective driven means 5. The lower end of each driven means 5 passes through the hollow portion of a respective push rod 2 to a retaining piece 50. When any pressing piece 3 is pressed, the driven means 5 will be driven by the driving means 4 so that the push rod 2 will be released through the pressing piece 3. In order that the left lever 41 and the right lever 42 are retained for horizontal movement, a lower protrusion 18 at the bottom surface of the cover 12 presses the upper surface of the left lever 41, and a larger protrusion 19 presses the upper surface of the right lever 42; a protrusion 16 in the seat 11 rests against the lower surface of the left lever 41, and a smaller protrusion 17 rests against the lower end surface of the right lever 42. Therefore, it is assured that the bodies of the levers 41 and 42 only move in a confining space defined between the corresponding protrusions 16, 17, 18 and 19.

Figure 5:
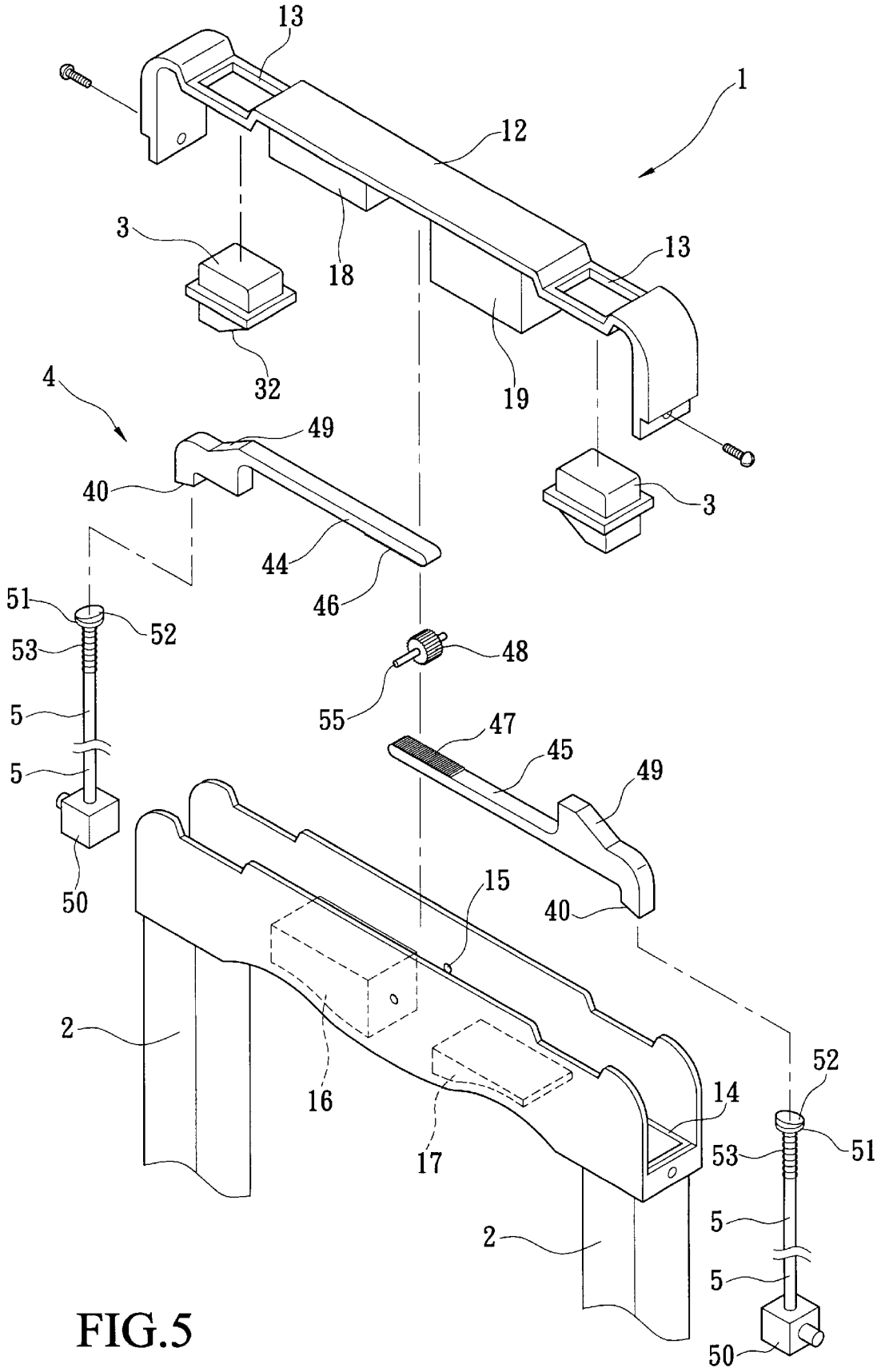
FIG. 5 is an exploded perspective view showing another embodiment of the present invention.
Figure 6:
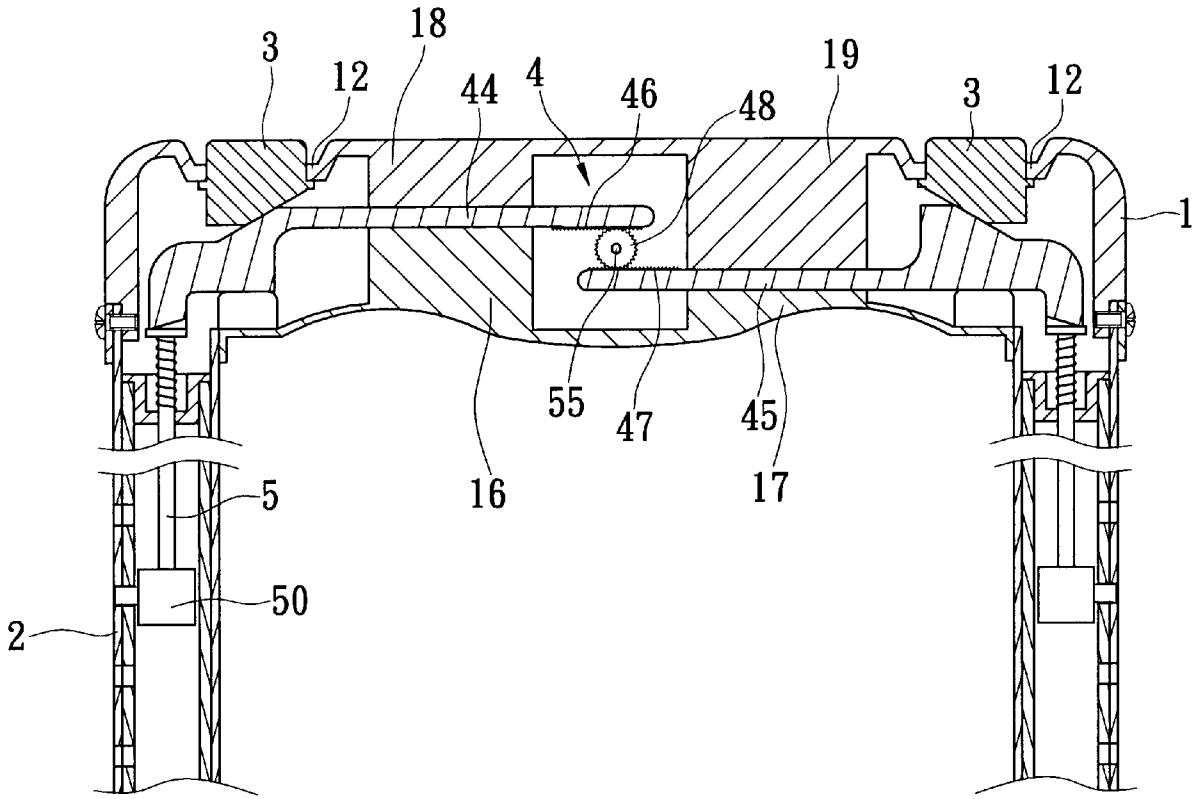
FIG. 6 is an assemble cross sectional view showing a further embodiment of the present invention.
Figure 7:
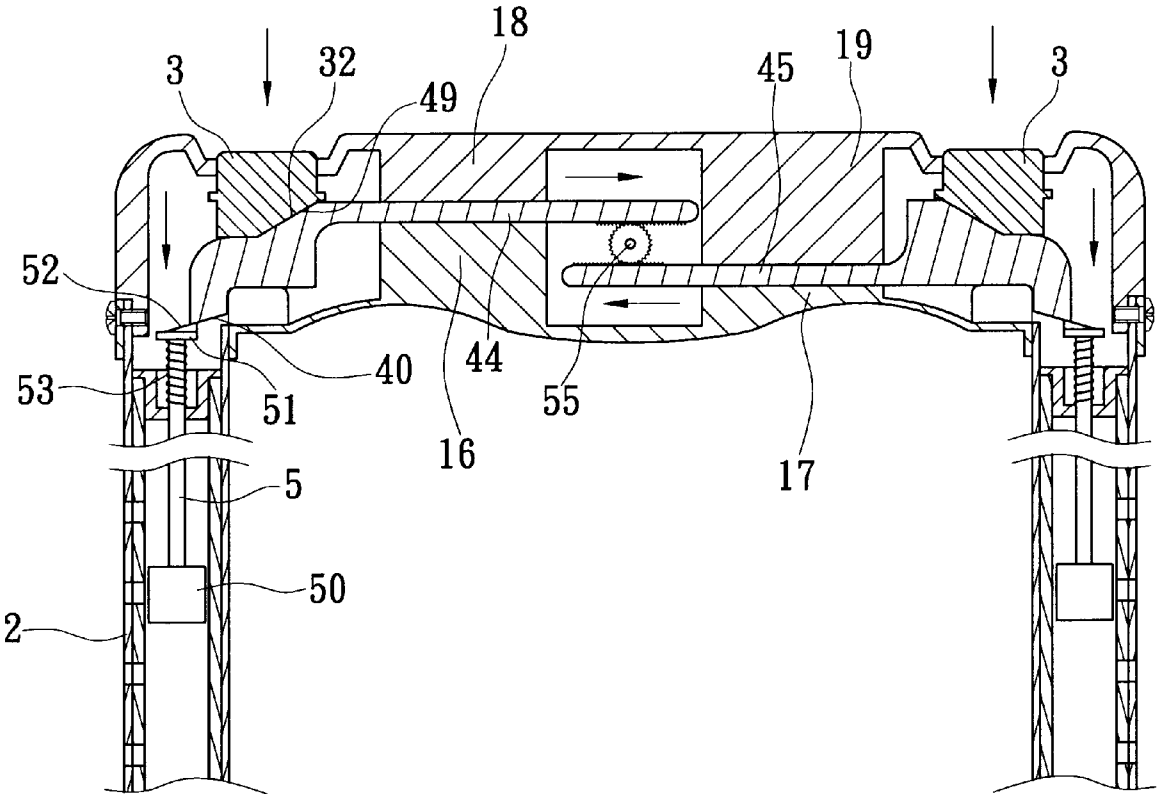
FIG. 7 is a cross sectional view showing the action in the further embodiment of the present invention.
Figure 8:
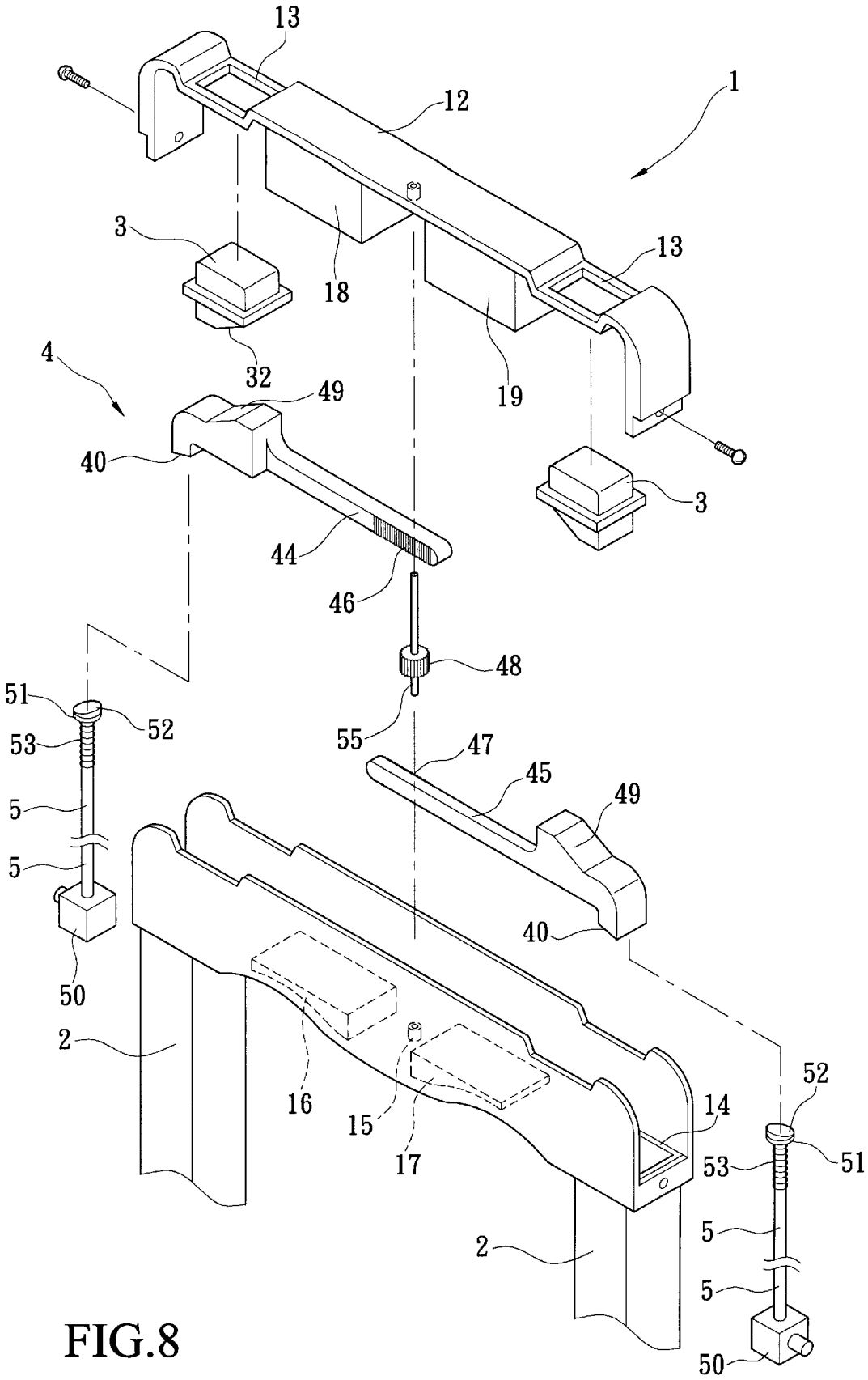
FIG. 8 is an exploded perspective view of a jet embodiment in the present invention.
Figure 9:
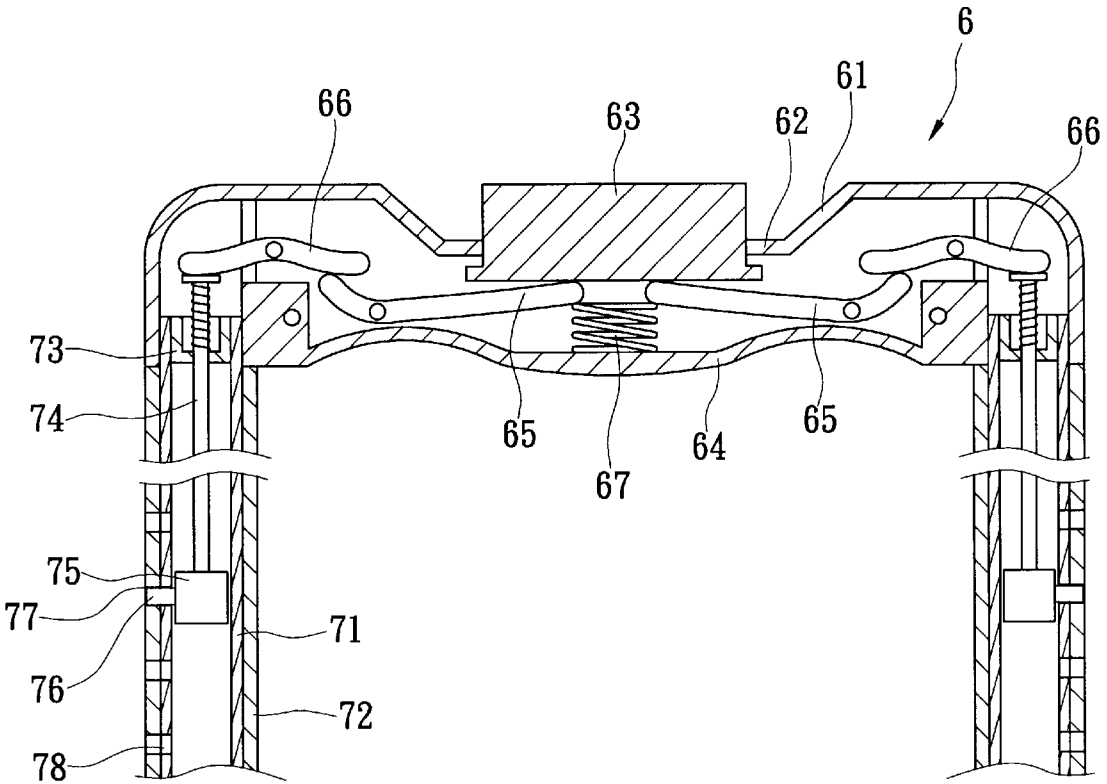
FIG.9 PRIOR ART
FIG. 9 is a cross sectional view of a prior art design.

As shown in FIGS. 5 to 7, another type of driving means 4 is formed by a gear and lever type racks. The sides thereof are installed with a left lever type rack 44 and a right lever type rack 45. Each has a respective rack portion 46,47 which are installed at the inner ends of the lever type racks 44 and 45. The rack portions 46, 47 of the lever type racks 44, 45 are connected to a gear 48 disposed therebetween so that the two lever type racks 44 and 45 are driven by one another. The gear 48 is fixed to the pin seat 15 of the seat 11 by a pin 55. Similarly, the lever type racks 44 and 45 with transverse rack portions 46 and 47 move transversely in a space formed by the protrusions 18 and 19 of the cover 12, which are not at the same elevation, and the protrusions 16 and 17 of the seat 11, which are not at the same elevation. The levers are alternately spaced longitudinally, as shown in FIG. 5 the alternate longitudinal arrangement may be changed to an alternate transverse arrangement, as shown in FIG. 8. Namely, the rack portions 46 and 47 are respectively arranged at the front and rear sides of the lever type racks 44 and 45, instead of being installed on the top and bottom sides, and the gear 48 is disposed upright. This is another embodiment of the present invention. A difference in the embodiment of FIG. 8, is that the lever type racks 44 and 45 with transverse rack portions 46 and 47 transversely move in a space formed by the protrusions 18 and 19 of the cover 12, which are at the same elevation, and the protrusions 16 and 17 of the seat 11, which are at the same elevation.

The lever type racks or levers may respectively be directly pressed and contacted by the pressing pieces. The bottom of each pressing piece 3 has a slanted bottom surface 32 for being connected to the corresponding slanted top surface 49 at the outer end of each lever. Each lever may be pivotally connected to or enclosed by the seat 11. Each pressing piece 3 has a lower edge 31 for preventing the pressing piece from sliding out of the respective through hole 13 in the cover 12. Alternately, each pressing piece 3 can be pivotally connected to the cover 12 or the seat 11. By means of the slanted bottom surface 32 of the pressing pieces 3, the elements of each lever move inwards or outwards, so that the lower slanted surface 40 of each lever is in contact with a respective top slanted surface 52 of the driven means 5. Thus, the top slanted surface 52 is driven by the driven means to move downwards. The driven means 5, in general, includes a generally used rope, steel rope, or a steel plate. A lid 51 is formed at the top of the driven means 5. A spring 53 is engaged between the lower portion of the lid 51 and the lower through hole 14 of the seat 11 for restoring the respective pressing piece 3 to its original position. Furthermore, the retaining piece 50 may have various structures, thus the details thereof will not be described further. The function thereof is to fix two sections of the push rod 2. When only one of the pressing pieces 3 is pressed, the driven means 5 will cause one driving element, a linkage or a gear, of the driving means 4, to drive the lever (lever or lever type rack) on the other side to operate. Meanwhile, the lever on the other side will press the respective driven means 5 on that side, to achieve the object of synchronous action.

In summary, in the present invention, a pair of pressing pieces are installed at two sides of a handle, and two ends of a driving means are connected to the pressing piece, respectively, and also connected to a driven means. The lower end of the driving means passes through a push rod to a retaining piece. The retaining piece serves to buckle and fix two sectional rods of a push rod. When any pressing piece is pressed, the driving means will drive the driven means at two sides of the handle so that the push rods are released and telescopically moved. By the function of the racks or linkages, two sides of the driving means cause the driven means at two sides to move simultaneously, the seat and cover are installed with protrusions with respect to the driving means so that the driving means moves in the space formed by the respective upper and lower protrusions. A spring 53 can be further added to each driven means to bias the pressing pieces. Therefore, the body of the handle, i.e., the middle section thereof being held by a hand, has no notch. Despite that the trunk is pulled by any hand, left or right, the hand will feel comfortable. If it is necessary to adjust the handle, it is only needed to press one of the pressing pieces with a thumb, and a telescopic adjustment is enabled. Therefore, the present invention can be used conveniently, instead of the prior art structure where the hand holding the handle must, in advance, be released from the handle.

Although the present invention has been described with reference to the preferred embodiments, it will be understood that the invention is not limited to the details described herein. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A handle for coupling to a pair of multi-sectional push rods of a trunk comprising:

a longitudinally extended seat, each of two sides of the seat being formed with a lower through hole for receiving a respective one of the push rods therein, each lower through hole being connected to an upper end of a respective multi-sectional push rod;

a longitudinally extended cover overlaying the seat, each of two sides of the cover being formed with an upper through hole;

a pair of pressing members respectively disposed in the upper through holes of the cover;

driving means is connected between the seat and the cover, each of two ends of the driving means having portions connected to a respective one of the pressing members; and, first driven means and second driven means respectively connected to the two ends of the driving means, a lower end of each of the first and second driven means passing through a respective push rod to a corresponding retaining piece thereof, each retaining piece providing releasable coupling between sections of a corresponding multi-sectional push rod, wherein responsive to depression of one of the pressing members, the driving means will drive the first and second driven means so that the pair of push rods are released to be moved telescopically.

2. The handle as claimed in claim 1, wherein the driving means includes (a) a pair of longitudinally displaceable lever type racks, each of the lever type racks having a rack portion formed on a respective inner side thereof, and (b) a gear rotatably coupled between the rack portions of the two lever type racks so that the lever type racks are moved interactively as the gear is rotated by longitudinal displacement of one of the lever type racks responsive to depression of a corresponding one of the pressing members.

3. The handle as claimed in claim 1, wherein the driving means includes (a) a left and a right lever longitudinally displaceably disposed between the cover and the seat, and (b) a linkage is connected between inner ends of the two levers, the linkage being pivotally connected at a center thereof.

4. The handle as claimed in claim 3, wherein two ends of the linkage each have a respective long hole formed therein, each of the long holes having a retaining pin passing therethrough for connection to a corresponding retaining hole formed in the inner end of a respective lever.

5. The handle as claimed in claim 1, wherein each of the first and second driven means is formed with a cover piece and a spring engaged between a corresponding one of the lower through holes of the seat and the cover piece.

6. The handle as claimed in claim 1, wherein the driving means and the pressing members are connected together by cooperative inclined surfaces respectively formed thereon.

7. The handle as claimed in claim 1, wherein the driving means and each of the first and second driven means are connected together by cooperative inclined surfaces respectively formed thereon.

8. The handle as claimed in claim 1, wherein the seat and the cover are each formed with protrusions extending toward the other and define a space therebetween, the driving means being movably disposed in the space between the protrusions.

* * * * *